US005346007A

United States Patent [19]

Dillon et al.

[11] Patent Number: 5,346,007

[45] Date of Patent: Sep. 13, 1994

[54] WELL COMPLETION METHOD AND APPARATUS USING A SCAB CASING

[75] Inventors: Patrick W. Dillon; William C. Billings, both of Bakersfield, Calif.

[73] Assignee: Mobil Oil Corporation, Fairfax, Va.

[21] Appl. No.: 47,988

[22] Filed: Apr. 19, 1993

[51] Int. Cl.[5] ..... E21B 43/00

[52] U.S. Cl. ..... 166/254; 166/278; 166/285

[58] Field of Search ..... 166/250, 254, 278, 285, 166/289, 290, 281, 369, 51

[56] References Cited

U.S. PATENT DOCUMENTS 3,865,188 2/1975 Doggett et al. ..... 166/285
4,474,243 10/1984 Gaines ..... 166/285 X
4,759,408 7/1988 Buchanan ..... 166/285 X
5,145,004 9/1992 Cornette ..... 166/278

*Primary Examiner*—Thuy M. Bui
*Attorney, Agent, or Firm*—Alexander J. McKillop; George W. Hager, Jr.

[57] ABSTRACT

A method and assembly for completing a wellbore having a production interval which, in turn, has at least one trouble zone (i.e. unproductive zone) intermediate two productive zones. A well assembly is lowered to position and cement a scab conduit across the trouble zone to seal the zone off from the rest of the open-hole production interval before completing the well by casing the wellbore and gravel-packing the production interval.

16 Claims, 2 Drawing Sheets

WELL COMPLETION METHOD AND APPARATUS USING A SCAB CASING

DESCRIPTION

1. Technical Field

The present invention relates to a well completion method and apparatus and in one of its aspects relates to a method and assembly using a scab conduit to seal off a trouble zone which lies between two productive zones within an open-hole, production interval of a wellbore.

2. Background

It is not uncommon to use an "open hole" completion when producing hydrocarbons or the like from subterranean formations. An "open hole" completion is one wherein a wellbore is drilled through the production interval but is only cased to top of the production interval thereby leaving the production interval uncased and open to the wellbore. This open interval is then often underreamed and gravel packed before the well is put on production.

Unfortunately, however, many production intervals have at least one "trouble zone" which lies between two production zones. As used herein, "trouble zone" is intended to cover those zones within an open production interval which do not contribute to the economic operation of the well and which, in many cases, actually hinder the operation of the well. Some examples of such trouble zones include those zones which produce excessive water and/or gas, and may also include zones which produce undesirable steam and/or bitumen flows into wellbore of wells which are drilled in geothermal areas.

When such trouble zones occur in a production interval, it is desirable to seal off and eliminate these zones before the well is put on production. When the trouble zone lies below a productive zone, this can easily be accomplished by merely plugging back the wellbore to a point above the trouble zone with cement prior to the casing and completion of the well. Likewise, if a trouble zone lies above the productive zone, the trouble zone can be easily isolated by merely casing the wellbore all the way down to the bottom of the trouble zone. However, isolating or sealing off the trouble zone becomes a much more difficult problem when the trouble zone lies between two productive zones in a production interval where the production interval is to be completed with an open-hole, gravel pack completion.

Several different techniques have been proposed for isolating an intermediate trouble zone within an open-hole, production interval which include the following: (1) drilling and completing a separate well for each productive zone of the production interval; (2) setting a slotted liner which extends through the entire production interval but leaving the section of liner which lies adjacent the trouble zone blank and, in some instances, then cementing behind only the blank section of the liner; (3) merely leaving the entire production interval open or leaving the entire production interval open and then attempting to isolate the trouble zone with a remedial workover following completion, i.e. casing, of the well; and (4) casing the wellbore to a point below the trouble zone and then milling out those portions of the casing which lie adjacent the productive zones with the portions of the casing to be milled preferably being made from fiberglass or some other easily millable material. While each of these techniques may do the job for a particular application, there still exists a need for a more convenient and/or less expensive method to seal off such trouble zones in open hole completions.

SUMMARY OF THE INVENTION

The present invention provides a method and assembly for completing a wellbore having a production interval which, in turn, has at least one trouble zone intermediate two productive zones. As noted above, a "trouble zone" is a zone within an open production interval which does not contribute to the economic operation of the well and which may actually hinder the operation of the well. Basically, the present invention involves locating the depth and determining the thickness of the trouble zone and then cementing a scab conduit across the zone to seal the zone off from the rest of the open-hole production interval before casing the wellbore and gravel-packing the production interval.

More specifically, the present invention involves drilling a wellbore through the production interval and logging the wellbore to locate the depth and determine the thickness of the trouble zone(s). The wellbore is reamed to the bottom of the trouble zone to produce a shoulder at that point. A tapered plug is dropped onto the shoulder to block the wellbore at that point.

A well assembly is made up at the surface and is comprised of a section of "scab" conduit which has a length slightly greater than the thickness of the trouble zone and an outer diameter which is slightly less than the reamed diameter of wellbore. The lower end of the scab conduit is affixed with a float shoe or the like which has a passage therethrough. A workstring (e.g. drill string) is releasably connected (e.g. by threads) to the passage in float shoe.

The well assembly is lowered until it engages the plug in the wellbore. Cement is pumped down the worksting, out the shoe, and into the annulus which is formed between the scab conduit and the wellbore. After the desired amount of cement has been pumped into the workstring, a plug or "dart" is pumped down the workstring to displace the remaining cement out of the workstring. The workstring is then unthreaded from shoe and is raised slightly so that any excess cement can be circulated out of the wellbore.

The workstring is then removed and a bit is lowered on a drillstring. As the string reaches the scab casing, the drill bit will be diverted by a drill guide on the upper end of the scab casing into and through the casing so that the bit can drill out both the shoe and the tapered plug to thereby reopen the wellbore below the now-cased, trouble zone.

In instances, where there may be more than one trouble zone within a production interval, the same procedure as described above is used to case the lowermost trouble zone first, then the next higher trouble zone, and so on. When all of the trouble zones within a production interval have been sealed off as described above, the wellbore is completed by casing the wellbore to the top of the production interval and then gravel packing the openhole, production interval. The gravel packing is preferably carried out by first underreaming the productive zones and then setting a fluid-permeable liner across the production interval. Gravel is then deposited around the liner throughout the production interval. Once the wellbore has been completed, production equipment (e.g. tubing strings, packers, etc.) is installed and the well is put on production.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
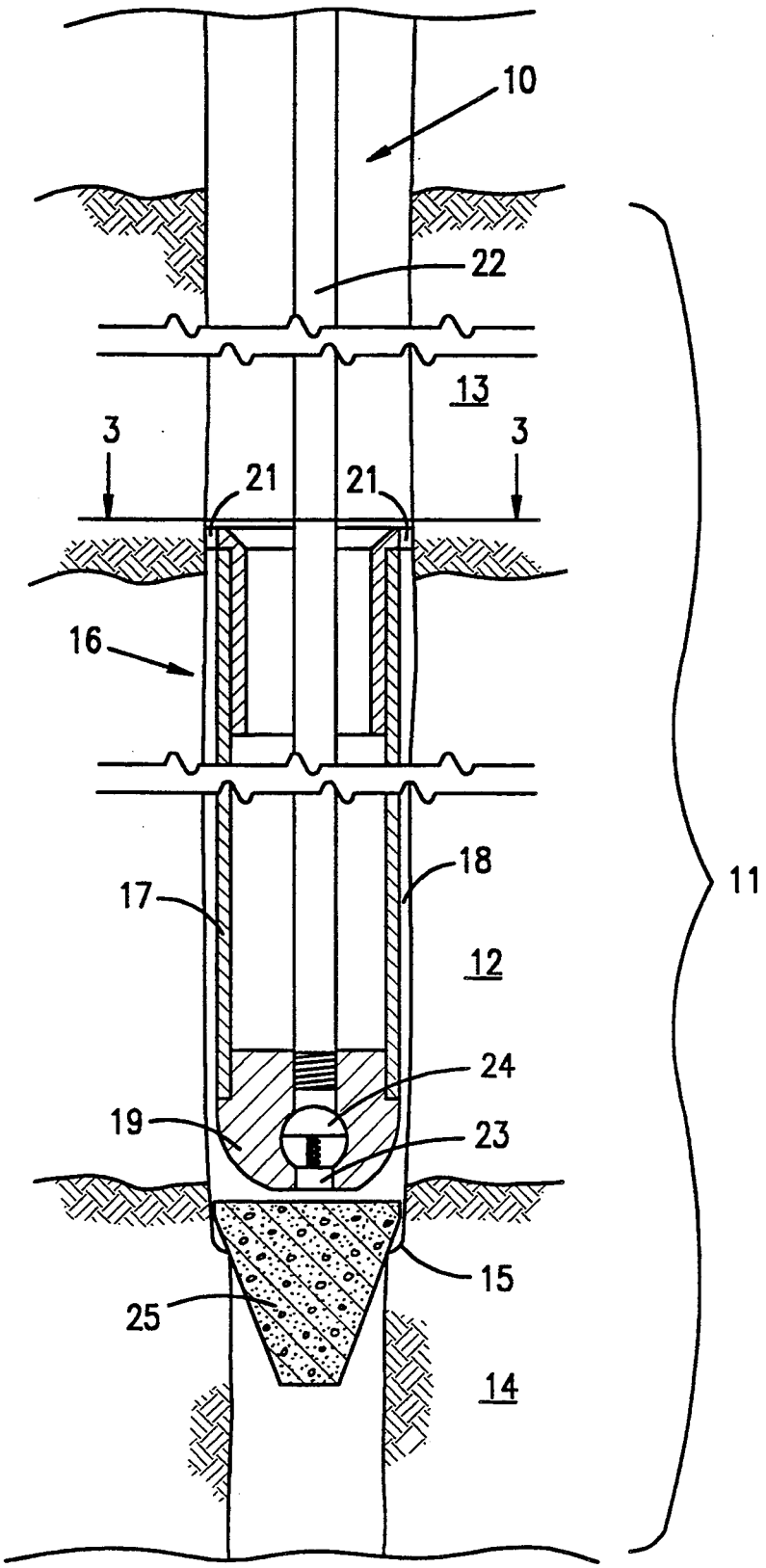
FIG. 1 is an elevational view, partly in section, of the lower portion of a typical wellbore in which the present invention is being carried out.

Referring now to the drawings, FIG. 1 illustrates the lower end of a typical wellbore in which the present invention is applicable. That is, wellbore 10 penetrates a production interval 11 which is comprised of at least one "trouble zone" 12 which, in turn, lies between an upper productive zone 13 and a lower productive zone 14. As used herein, "trouble zone" is intended to cover those zones within an open production interval which do not contribute to the economic operation of the well and which, in many cases, actually hinder the operation of the well. Some examples of such trouble zones include those zones which produce excessive water and/or gas or which may produce steam and/or bitumen flows where the wellbore Penetrates geothermal formations.

Wellbore 10 is drilled from the surface and through the production interval 11. The well is then logged in accordance with well known procedures to locate the depth and thickness of trouble zone(s) 12 (only one shown). Next, wellbore 10 is reamed to enlarge its diameter to a depth substantially adjacent the bottom of trouble zone 12 thereby producing an annular shoulder 15 at that point. If there is more than one trouble zone within a particular production interval, the lowermost trouble zone will be addressed first.

At some point in time, well assembly 16 is made up at the surface. Assembly 16 is comprised of a section of "scab" conduit 17 (e.g. regular well casing) which has a length slightly greater than the thickness of said trouble zone 12 so it will extend through zone 12 when the assembly is in an operable position within the wellbore. Scab conduit 17 has an outer diameter which is slightly less than the reamed diameter of wellbore 10 whereby an annulus 18 is formed when conduit 17 is in an operable position within the wellbore. The lower end of scab conduit 17 is affixed with a float shoe 19 or the like. Shoe 19 has a passage 23 therethrough which is closed against upward flow by a spring-assisted, check valve 24. Shoes or subs such as float shoe 19 are well known and are commercially-available from a variety of suppliers. Preferably, shoe 19 is a commercially-available, "screw-in" float shoe with a latch-down means.

Figure 3:
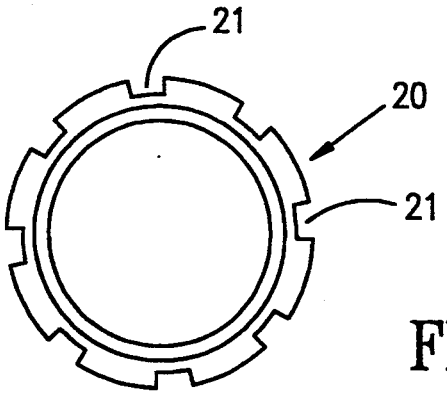
FIG. 3 is a cross-sectional view taken along line 3—3 of FIG. 1 with the workstring removed.

Drill guide 20 is positioned in and is attached to the upper end of scab conduit 17. The funnel-like, drill guide 20, the purpose of which will become obvious from the following description, is flared at its top and has a plurality of radially-spaced flutes or slots 21 (FIGS. 1 and 3) to allow fluid to flow past the scab conduit 17. Also, as will be understood by those skilled in the well cementing art, casing centralizers (not shown) are preferably positioned on the outer surface of conduit 17 similarly as is done in standard cementing operations to center conduit 17 within the wellbore. A workstring 22 (e.g. drill string) is releasably connected (e.g. by threads) to the passage 23 in float shoe 19 so that fluid flowing through the workstring will flow around check valve 24 and out of shoe 19.

Next, a tapered plug 25 or the like is dropped down wellbore 10 and onto shoulder 15 to thereby pack-off and block flow through the wellbore at that point. Plug 25 is preferably made of cement or other easily drillable material for a purpose described below. Well assembly 16 is then lowered until it engages plug 25. Both the workstring 22 and the wellbore above the plug 22 will be filled with fluid (e.g. drilling mud) as assembly 16 is lowered into the wellbore. Cement is then pumped down workstring 22, through passage 23 in shoe 19, and into annulus 18 behind scab conduit 17. Preferably, approximately double the amount of cement calculated as needed to fill annulus 18 is pumped to insure that a good bond will be acquired between the wellbore and the conduit. Flutes 21 in drill guide 20 allows the excess cement to flow pass the top of the conduit and into the wellbore. Also, as will be recognized by those skilled in the well cementing art, assembly 16 will be slightly reciprocated by workstring 22 during the pumping of the cement which improves the compactness of the cement behind the conduit and which provides adequate space between the bottom of shoe 17 and the top of plug 25 for the cement to readily flow from the shoe and into the annulus 18.

After the desired amount of cement has been pumped into the workstring, a standard-type plug or "dart" (not shown) such as those used in routine well cementing operations, is positioned onto the cement in worksting. A spacer-slug of water or the like, followed by drilling mud, is pumped down workstring 22 to displace the cement out of the workstring. As the dart reaches shoe 19, it engages and is latched therein to thereby close passage 23 against downward flow.

Next, the pressure in worksting 22 is bled off to determine if there is any back flow in the workstring. The worksting is then picked up to take the weight off the string so that it can be easily unthreaded from shoe 19. A expansion joint, e.g. bumper sub (not shown) may be incorporated into workstring 22 near shoe 19 to aid in determining when the workstring become released from the shoe. The workstring is then picked up to a point just above the shoe and drilling mud is circulated through the wellbore to remove excess cement.

The workstring is then removed from the hole. After adequate curing time for the cement has passed, a bit (not shown) is lowered on a drillstring (e.g. workstring 22). As it reaches scab casing 17, the bit will be directed by guide 20 into the casing with substantially no damage to the conduit. The drillstring is then rotated to drill out both the shoe 19 and the plug 25, thereby reopening the wellbore below the trouble zone 12.

In instances, where there may be a plurity of trouble zones (only one shown) which lies between two different productive zones within a production interval, the lowermost trouble zone will cased first, then the next higher trouble zone, and so on. Each additional trouble zone will be cased exactly in the same manner as described above. That is, the wellbore will be reamed to further enlarge the diameter of the wellbore to a depth adjacent the bottom of the next upper trouble zone to be cased thereby providing a new shoulder at that point. A plug such as cement plug 25 will be landed on the new shoulder and a well assembly such as assembly 16 will be lowered to cement a scab conduit across the upper trouble zone precisely as described above.

Figure 2:
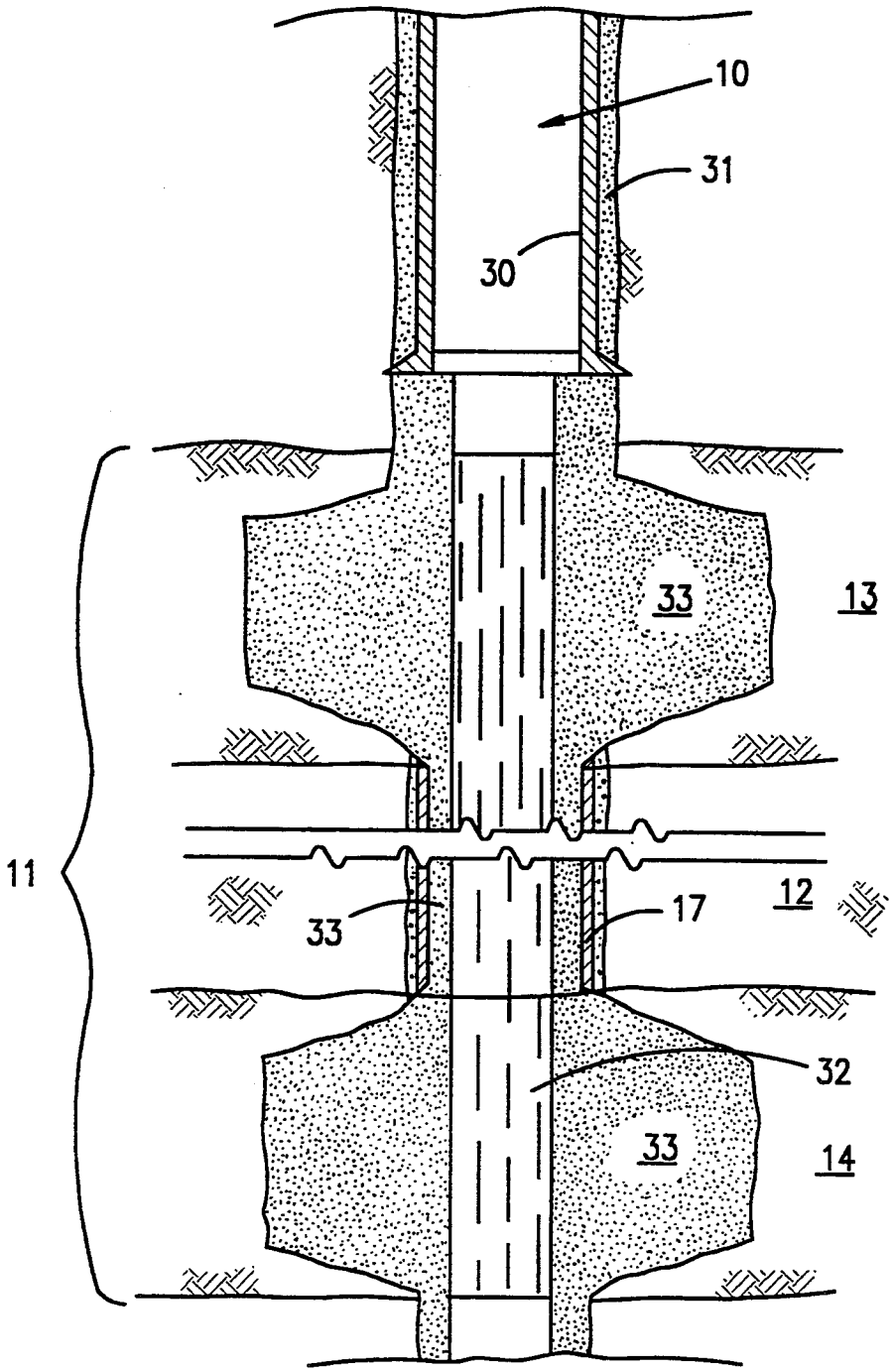
FIG. 2 is an elevational view, partly in section, of the wellbore of FIG. 2 after the wellbore has been completed in accordance with the present invention.

When all of the trouble zones within a production interval have been sealed off as described above, wellbore 10 is then completed. That is, wellbore 10 is cased to a point approximately adjacent the top of production interval 11 and then the production interval 11 is completed with an open-hole, gravel pack completion. As shown in FIG. 2, wellbore 10 is cased and cemented (i.e. casing 30, cement 31) to a point approximately adjacent the top of the production interval 11. Then, both the upper and lower productive zones 13, 14, respectively, are underreamed in accordance with known procedures and a fluid-permeable liner 32 or the like is positioned to extend across production interval 11. As used herein, "fluid-permeable liner" is meant to be generic and may include any and all types of liners (e.g. screens, slotted pipes, screened pipes, perforated liners, pre-packed screens and/or liners, combinations of same, etc.) which are used or could be used in well completions of this general type. As will be recognized by those skilled in the art, there are presently several known suppliers from whom such "liners" are readily commercially available. The liner may be of a continuous length, as shown, or it may be comprised of a plurality of segments connected by subs or "blanks".

Next, as will be understood in the art, a gravel slurry is flowed down a standard gravel pack workstring and necessary cross-overs (not shown) to deposit gravel 33 in and to fill the underreamed, productive intervals 13, 14 and the annulus formed between the scab casing 17 and liner 32. "Gravel" as used herein is intended to include all particulate and/or aggregate materials (e.g. gravel, sand, combinations, etc.) which are used or can be used in gravel pack or fractured completions. As known in the art, the "gravel" particles used in a particular situation are sized so as to block or filter out the particulates which may be produced with the well fluids from the productive zones.

Once the wellbore 10 has been completed and the production interval gravel packed, production equipment (e.g. tubing strings, packers, etc. ) can now be installed and the well is ready to be put on production.

What is claimed is:

1. A method for completing a production interval of a wellbore wherein said production interval has at least one trouble zone intermediate two productives zones, said method comprising:

locating said at least trouble zone within said production interval;

positioning a scab conduit across said trouble zone while leaving said two productive zones open to said wellbore; and cementing said scab conduit in said wellbore to thereby seal off said at least one trouble zone from said wellbore.

2. The method of claim 1 including:

gravel packing said production interval after said scab conduit has been cemented within said wellbore.

3. The method of claim 2 wherein said gravel packing comprises:

underreaming both of said productive zones which lie above and below, respectively, said scab conduit;

positioning a fluid-permeable liner within said wellbore whereby said liner will traverse across said scab conduit and both of said two productive zones; and filling both of said underreamed productive zones and the annulus formed between said scab conduit and said wellbore with gravel.

4. The method of claim 1 wherein said scab conduit is lowered on the same workstring which is used in cementing the scab conduit in the wellbore.

5. A method for completing a production interval of a well wherein said production interval has at least one trouble zone intermediate two productives zones, said method comprising:

drilling a wellbore through said production interval;

logging said wellbore to locate said trouble zone within said production interval;

enlarging the diameter of said wellbore to a point substantially adjacent the bottom of said at least one trouble zone to thereby provide a shoulder in the wellbore adjacent the bottom of said at least one trouble zone;

lowering a scab conduit on a workstring, said conduit having (a) a length greater than the thickness of said at least one trouble zone so that said conduit will extend across said zone when it in an operable position and (b) a diameter slightly smaller that the enlarged diameter of said wellbore;

positioning said scab conduit onto said shoulder whereby an annulus is formed between said conduit and said wellbore; and flowing cement through said workstring and into said annulus behind said scab conduit to cement said conduit within said wellbore and thereby seal off said at least one trouble zone.

6. The method of claim 5 including:

blocking off said wellbore below said shoulder prior to lowering said scab conduit.

7. The method of claim 6 wherein said wellbore is blocked by lowering a plug onto said shoulder.

8. The method of claim 7 wherein said plug is comprised of an easily drillable material.

9. The method of claim 6 wherein said lowering and cementing said scab conduit comprises:

affixing said scab conduit to the outer perimeter of a float shoe which has a passage therethrough;

threading said workstring into said passage of said float shoe;

lowering said scab conduit and float shoe in said wellbore onto said shoulder;

flowing cement down said workstring, out said passage in said float shoe, and into said annulus behind said scab conduit;

allowing said cement to harden; and unthreading said workstring from said shoe and removing said workstring.

10. The method of claim 9 including:

lowering a drill string into said wellbore and through said scab conduit and drilling out said float shoe and said plug to open said wellbore.

11. The method of claim 10 including:

gravel packing said production interval after said wellbore below said scab conduit has been opened.

12. The method of claim 11 wherein said gravel packing comprises:

underreaming both of said productive zones which lie above and below, respectively, said scab conduit;

positioning a fluid-permeable liner within said wellbore whereby said liner will tranvese across said scab conduit and both of said two productive zones; and filling both of said underreamed productive zones and the annulus formed between said liner and said scab conduit with gravel.

13. A well assembly for completing a production interval of a wellbore which has at least one trouble zone lying between two productive zones; said assembly comprising:

a scab conduit having (a) a length greater than the thickness of said trouble zone and sufficient to extend across said trouble zone when in an operable position and (b) a diameter slightly less than that of the wellbore through said trouble zone;

a float shoe or the like having a passage therethrough affixed to the lower end of said scab conduit; and a workstring releasably connected to said float shoe and in fluid communication with said passage in said shoe.

14. The well assembly of claim 13 wherein said workstring is comprised of drill pipe.

15. The well assembly of claim 14 where said drill pipe is releasably connected to said float shoe by threads.

16. The well assembly of claim 13 including:

a drill guide positioned within said upper end of said scab conduit and affixed thereto.

* * * * *